US010822196B2

(12) United States Patent
Fauconnet

(10) Patent No.: US 10,822,196 B2
(45) Date of Patent: Nov. 3, 2020

(54) CONTROL SYSTEMS AND METHODS FOR ELEVATORS

(71) Applicant: Otis Elevator Company, Farmington, CT (US)

(72) Inventor: Aurelien Fauconnet, Isdes (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 554 days.

(21) Appl. No.: 15/666,610

(22) Filed: Aug. 2, 2017

(65) Prior Publication Data

US 2018/0044132 A1 Feb. 15, 2018

(30) Foreign Application Priority Data

Aug. 9, 2016 (EP) ..... 16306035

(51) Int. Cl.
*B66B 1/34* (2006.01)
*B66B 1/28* (2006.01)
*B66B 5/00* (2006.01)

(52) U.S. Cl.
CPC ..... *B66B 1/28* (2013.01); *B66B 1/3476* (2013.01); *B66B 5/0012* (2013.01); *B66B 2201/222* (2013.01)

(58) Field of Classification Search
CPC ..... B66B 1/28; B66B 1/3476; B66B 5/0012
USPC ..... 187/247
See application file for complete search history.

(56) References Cited

U.S. PATENT DOCUMENTS 3,973,649 A 8/1976 Iwasaka et al.
4,555,724 A 11/1985 Enriquez
5,331,121 A 7/1994 Tsuji
5,490,580 A 2/1996 Powell et al.
5,518,086 A 5/1996 Tyni
6,173,816 B1 1/2001 Powell et al.
6,615,175 B1 9/2003 Gazdzinski
8,334,906 B2 12/2012 Lipton et al.
8,540,057 B2 * 9/2013 Schuster ..... B66B 1/34 187/247
9,463,808 B2 * 10/2016 VanBlon ..... B60W 50/0098
9,573,789 B2 * 2/2017 Appana ..... B66B 1/2408
10,239,728 B2 * 3/2019 Finn ..... B66B 1/3476
10,308,477 B2 * 6/2019 Patel ..... B66B 1/2458

(Continued)

FOREIGN PATENT DOCUMENTS

CN 103964271 A 8/2014
EP 0452130 A2 10/1991

(Continued)

OTHER PUBLICATIONS

European Search Report, European Application No./Patent No. 16306035.3-1731, dated Jan. 31, 2017, European Patent Office; European Search Report 10 pages.

*Primary Examiner* — David S Warren
(74) *Attorney, Agent, or Firm* — Cantor Colburn LLP

(57) ABSTRACT

Elevator control system including an elevator car, an elevator controller, and an occupancy detection system configured to detect an occupancy level within the elevator car, the occupancy detection system comprising at least one camera. The elevator controller and the occupancy detection system are configured control the elevator car to prevent additional passengers from entering the elevator car when the occupancy detection system detects an occupancy level above a predetermined threshold.

15 Claims, 4 Drawing Sheets

(56) References Cited

U.S. PATENT DOCUMENTS

| | | | | |
|---|---|---|---|---|
| 2007/0240944 | A1 | 10/2007 | Hirade | |
| 2007/0272493 | A1* | 11/2007 | Legez | B66B 1/20 187/313 |
| 2011/0067958 | A1* | 3/2011 | Schuster | B66B 1/34 187/393 |
| 2015/0274485 | A1* | 10/2015 | Appana | B66B 1/2408 187/381 |
| 2016/0251199 | A1* | 9/2016 | Kronkvist | B66B 1/468 187/381 |
| 2016/0264149 | A1* | 9/2016 | VanBlon | B60W 50/0098 |
| 2016/0297642 | A1* | 10/2016 | Finn | B66B 1/3476 |
| 2017/0197807 | A1* | 7/2017 | Noda | G06K 9/00335 |
| 2017/0327344 | A1* | 11/2017 | Richmond | B66B 5/0012 |
| 2018/0044132 | A1* | 2/2018 | Fauconnet | B66B 1/28 |
| 2018/0111787 | A1* | 4/2018 | Patel | B66B 1/2458 |
| 2020/0131006 | A1* | 4/2020 | Rampone | B66B 13/26 |

FOREIGN PATENT DOCUMENTS

| | | | |
|---|---|---|---|
| JP | H07215611 | A | 8/1995 |
| JP | H07215612 | A | 8/1995 |
| JP | 2000034079 | A | 2/2000 |
| JP | 2003012243 | A | 1/2003 |
| JP | 2011032087 | A | 2/2011 |
| JP | 2015020871 | | 2/2015 |
| WO | 2016085795 | A1 | 6/2016 |

* cited by examiner

CONTROL SYSTEMS AND METHODS FOR ELEVATORS

CROSS-REFERENCE TO RELATED APPLICATIONS

This application claims the benefit of European Application No. 16306035.3 filed Aug. 9, 2016, which is incorporated herein by reference in its entirety.

BACKGROUND

The subject matter disclosed herein generally relates to elevator control systems and methods of operation and, more particularly, to elevator control systems taking into account passengers already within elevator cars.

Elevator systems are designed to efficiently move people within buildings. However, elevators have limited capacity (e.g., volume, weight, etc.) and thus can only move a certain number of people at a given time. When a potential passenger wishes to travel within an elevator car, the potential passenger must press an elevator call button. The elevator call button typically enables an indication of "up" or "down," and pressing the associated call button will indicate to an elevator controller that an elevator car traveling in the appropriate direction should stop at the requested landing floor. However, there are instances when an elevator car is full (of passengers or passengers and items) such that the potential passenger cannot board the elevator car. Thus, the elevator car will make a stop at a landing floor, but no one may exit or enter the elevator car. Further, in some instances, at a time of loading, multiple passengers may load into an elevator car to the point of capacity. When full, the elevator car doors may start to close. However, a potential passenger can press the elevator call button, and the elevator doors may re-open, thus delaying all other passengers already boarded on the elevator car, and further the potential passenger cannot board because the elevator car is already full. Thus, improved elevator call can provide efficiencies in transporting people within buildings.

SUMMARY

According to one embodiment, elevator control systems include an elevator car, an elevator controller, and an occupancy detection system configured to detect an occupancy level within the elevator car, the occupancy detection system comprising at least one camera. The elevator controller and the occupancy detection system are configured to control the elevator car to prevent additional passengers from entering the elevator car when the occupancy detection system detects an occupancy level above a predetermined threshold.

In addition to one or more of the features described above, or as an alternative, further embodiments of the elevator control system may include that the occupancy detection system comprises at least one detector mounted in the elevator car.

In addition to one or more of the features described above, or as an alternative, further embodiments of the elevator control system may include that the at least one detector comprises a camera.

In addition to one or more of the features described above, or as an alternative, further embodiments of the elevator control system may include that the at least one detector is mounted to at least one of an elevator wall or an elevator ceiling.

In addition to one or more of the features described above, or as an alternative, further embodiments of the elevator control system may include that the predetermined threshold is a value of 50% or greater of occupancy of the elevator car.

In addition to one or more of the features described above, or as an alternative, further embodiments of the elevator control system may include that the occupancy detection system captures a reference image of the elevator car and compares currently captured images with the reference image to determine the occupancy level.

In addition to one or more of the features described above, or as an alternative, further embodiments of the elevator control system may include that preventing additional passengers from entering the elevator car comprises at least one of (i) prevent the elevator car from stopping at any landings where a potential passenger has requested an elevator but no current occupant/passenger has requested to exit, (ii) close elevator doors of the elevator car, or (iii) prevent reopening of the elevator doors once a door closing operation starts.

In addition to one or more of the features described above, or as an alternative, further embodiments of the elevator control system may include a weight sensor configured to provide information to at least one of the elevator controller or the occupancy detection system such that a determination regarding the occupancy level of the elevator car is based in part on the current weight of the elevator car.

According to other embodiments, methods of controlling an elevator include detecting an occupancy level within an elevator car with an occupancy detection system and preventing additional passengers from entering the elevator car when the occupancy detection system detects an occupancy level above a predetermined threshold.

In addition to one or more of the features described above, or as an alternative, further embodiments of the method may include that the occupancy detection system comprises at least one detector mounted in a ceiling of the elevator car.

In addition to one or more of the features described above, or as an alternative, further embodiments of the method may include that the at least one detector comprises a camera having a fish-eye lens.

In addition to one or more of the features described above, or as an alternative, further embodiments of the method may include that the predetermined threshold is a value of 50% or greater of occupancy of the elevator car.

In addition to one or more of the features described above, or as an alternative, further embodiments of the method may include capturing a reference image of the elevator car and comparing a currently captured image with the reference image to determine the occupancy level.

In addition to one or more of the features described above, or as an alternative, further embodiments of the method may include that preventing additional passengers from entering the elevator car comprises at least one of (i) preventing the elevator car from stopping at any landings where a potential passenger has requested an elevator but no current occupant/passenger has requested to exit, (ii) closing elevator doors of the elevator car, or (iii) preventing reopening of the elevator doors once a door closing operation starts.

In addition to one or more of the features described above, or as an alternative, further embodiments of the method may include detecting a weight of the elevator car, wherein detection of the occupancy of the elevator car includes the detected weight.

Technical effects of embodiments of the present disclosure include an occupancy detection system configured to efficiently move elevator cars within an elevator system such that fully occupied elevator cars are not delayed or stopped unnecessarily at floors where no passengers will exit and no potential passengers could enter the elevator car because it was full.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
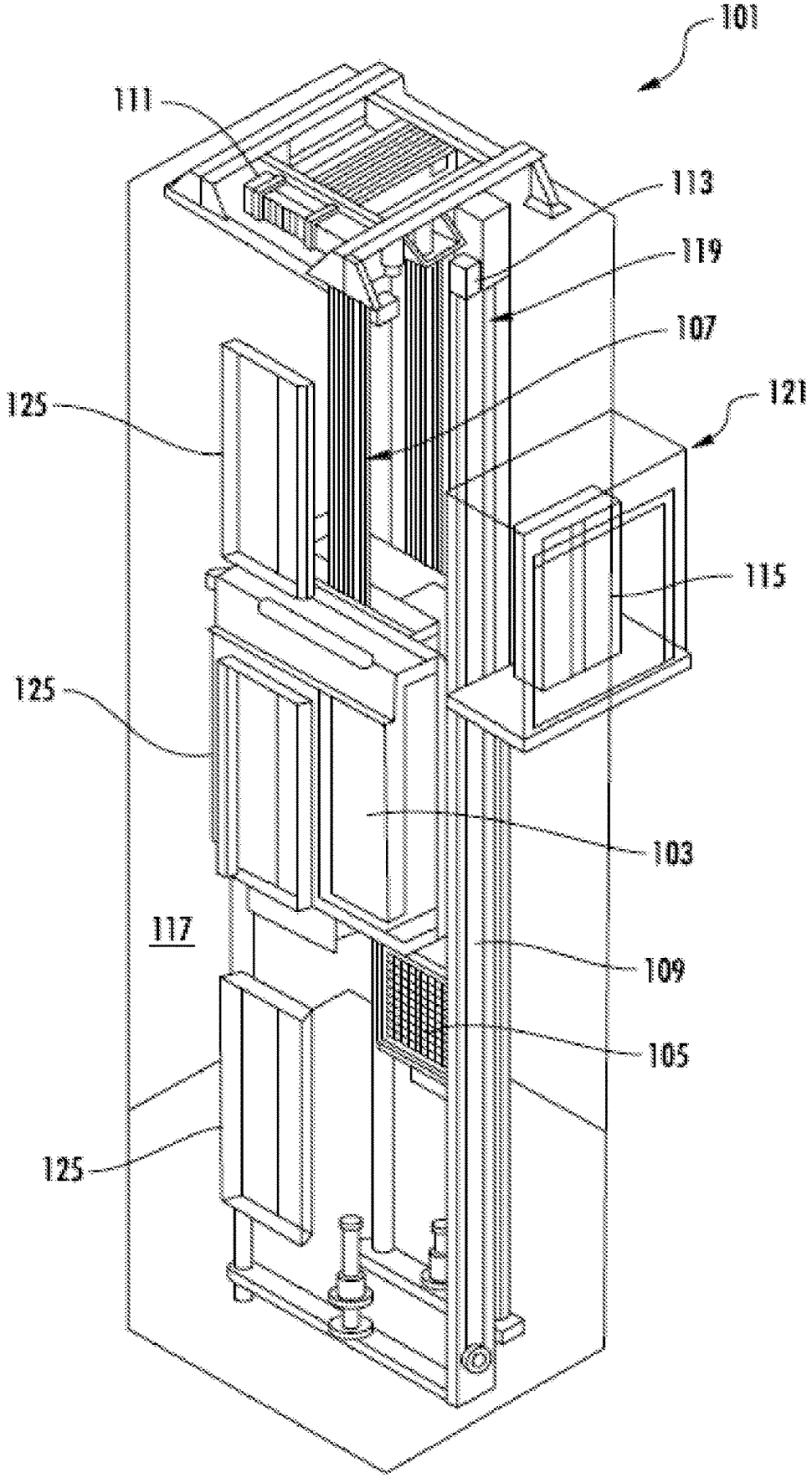
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
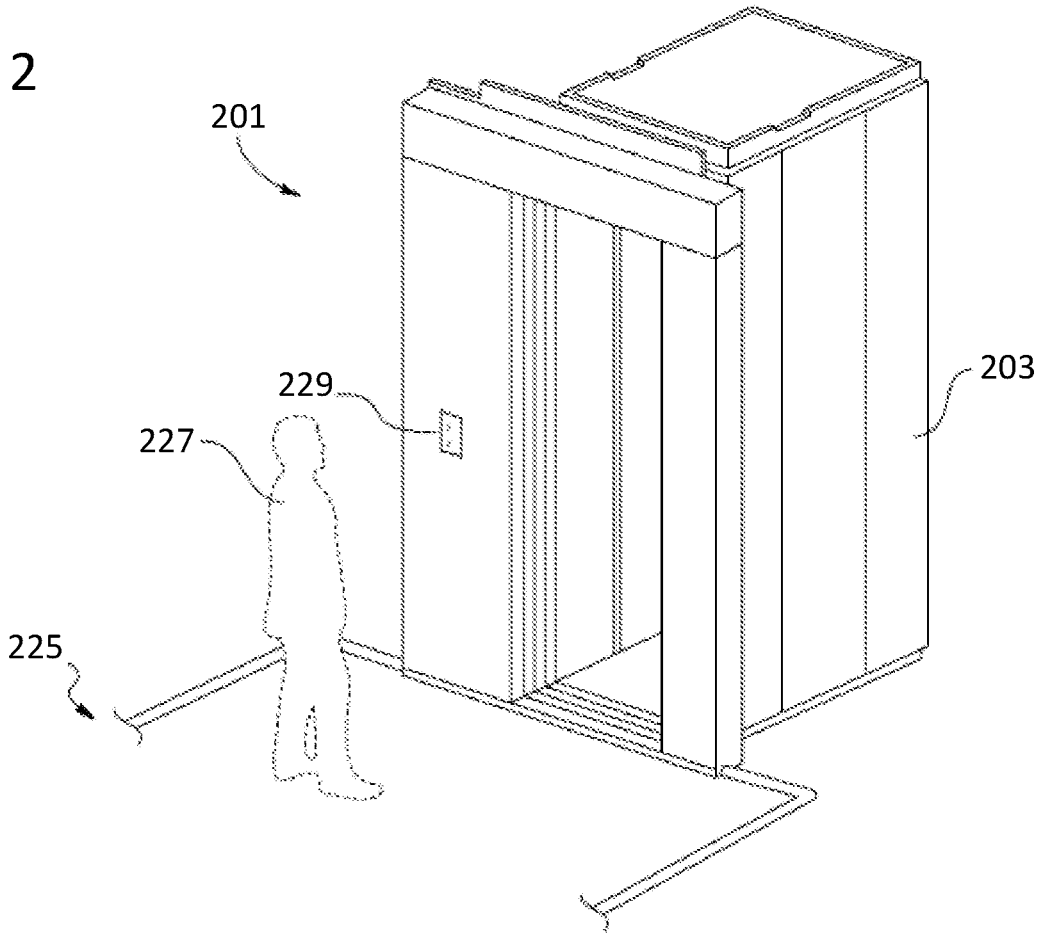
FIG. 2 is a schematic illustration of a landing floor of an elevator system that may employ various embodiments of the disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger 227 that desires to travel to another floor within a building. The passenger 227 can call the elevator car 203 by pressing a call button on a hall call panel 229. The hall call panel 229 is in operable communication with an elevator controller (e.g., elevator controller 115 of FIG. 1) and can make a request such that an elevator car will stop at the landing 225. The hall call panel 229 can be used to request travel in a desired direction (e.g., up or down), as known in the art. When the elevator car 203 reaches the landing 225, one or more elevator doors, including elevator car doors and landing doors, may open, allowing the passenger 227 to enter or exit the elevator car 203.

The elevator system (e.g., elevator systems 101, 201) can be used to transport passengers and items between floors or landings of a building. However, as noted above, elevators have limited capacity (e.g., volume, weight, etc.) and thus can only move a certain number of people or items at a given time. When a potential passenger wishes to travel within an elevator car, the potential passenger must press an elevator call button. The elevator call button typically enables an indication of "up" or "down," and pressing the associated call button will indicate to an elevator controller that an elevator car traveling in the appropriate direction should stop at the requested landing floor. However, there are instances when an elevator car is full (of passengers or passengers and items) such that the potential passenger cannot board the elevator car. Thus, the elevator car will make a stop at a landing floor, but no one may exit or enter the elevator car. Further, in some instances, at a time of loading, multiple passengers may load into an elevator car to the point of capacity. When full, the elevator car doors may start to close. However, a potential passenger can press the elevator call button, and the elevator doors may re-open, thus delaying all other passengers already boarded on the elevator car, and further the potential passenger cannot board because the elevator car is already full. Thus, improved elevator call can provide efficiencies in transporting people within buildings.

Embodiments provided herein are directed to elevator control systems and elevator hall call buttons that enable efficient movement of passengers and/or cargo within a building by accounting for current occupancy of an elevator car when deciding to stop an elevator car at a landing. Such control can be achieved with a device configured to detect an elevator occupancy and make a decision based on the detected occupancy. For example, in some embodiments, a camera or other detector can be located within an elevator car and a processor connected thereto can count the number of passengers inside an elevator car. In other embodiments, or in combination therewith, a detection of occupied volume can be measured. Further still, a weight measurement may be made to detect a filled capacity of an elevator car.

Figure 3A:
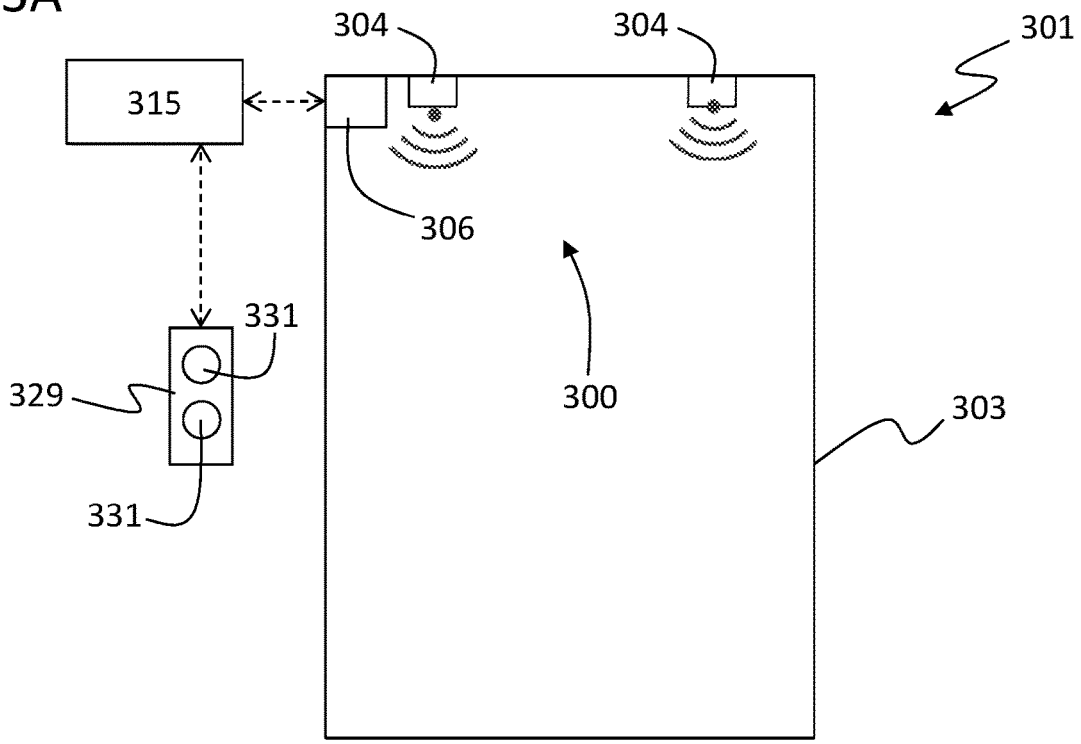
FIG. 3A is a side elevation schematic illustration of an elevator system having an occupancy detection system in accordance with an embodiment of the present disclosure.
Figure 3B:
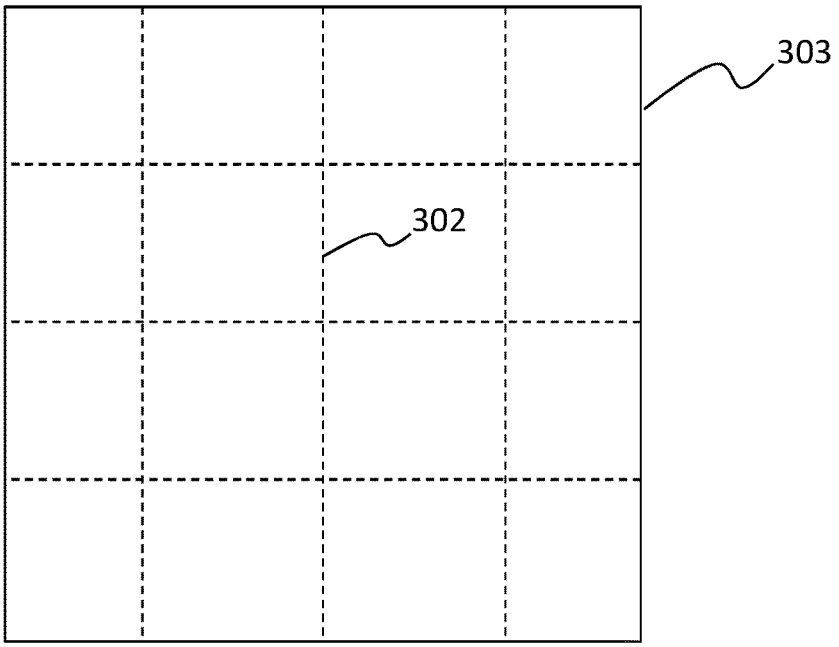
FIG. 3B is a top down plan illustration of the elevator car of FIG. 3A illustrating a detection grid in accordance with an embodiment of the present disclosure.

Turning now to FIGS. 3A-3B, schematic illustrations in accordance with a non-limiting embodiment in accordance with the present disclosure are shown. FIG. 3A is a side elevation illustration of an elevator system 301 having an elevator car 303 with an occupancy detection system 300 installed therein. FIG. 3B is a top down plan illustration showing a detection grid 302 of the occupancy detection system 300 of FIG. 3A.

As shown in FIG. 3A, the elevator system 301 is schematically shown, and those of skill in the art will appreciate that various components are omitted for ease of discussion. The elevator system 301 includes an elevator car 303 that is driven within an elevator shaft and can be called to one or more landings or floors within a structure. The operation of the elevator car 303 is controlled by an elevator controller 315. The elevator controller 315 is in communication with one or more hall call panels 329, with the hall call panels 329 having one or more hall call buttons 331 (e.g., directional buttons (up or down)). The hall call buttons 331 are in operable communication with the elevator controller 315. When one or more of the hall call buttons 331 are pressed by potential passengers at a landing, the hall call panel 329 sends a signal to the elevator controller 315 to request the elevator car 303 to stop at the requested landing and to travel in a desired direction (e.g., up or down). The elevator controller 315 will then control a machine to have the elevator car 303 stop at the requested landing when next the elevator car 303 is traveling in the requested direction.

As noted above, at times, the elevator car 303 may be full, and thus a requesting or potential passenger may not be able to enter or load into an elevator car, even though the elevator car 303 has stopped at the requested floor. A full elevator car may be filled by passengers and/or cargo (e.g., items carried or transported by the passengers). In the embodiment of FIGS. 3A-3B, the elevator car 303 is configured with an occupancy detection system 300. The occupancy detection system 300 is configured to detect if the elevator car 303 is full, and if so, the occupancy detection system 300 is configured to communicate with the elevator controller 315 to prevent the elevator car 303 from stopping at a requested floor or landing. That is, the elevator car 303 can be moved quickly to appropriate floors or landings without stopping at floors or landings where no passengers will exit the elevator car 303 (e.g., floors where a request is made but the elevator is already full). That is, floors where no passengers intend to exit the elevator car and no passengers could enter because the elevator car is already full can be avoided.

In the occupancy detection system 300 of FIGS. 3A-3B, the occupancy detection system 300 includes one or more detectors 304 and a control unit 306. The detectors 304 can be cameras, optical detectors, infrared detectors, motion detectors, or other types of detectors as known in the art. A detection grid 302 is generated by the detectors 304 such that all floor space or volume of the elevator car 303 is detected by the detectors 304. The detection grid 302 is merely on example of how an occupancy detection system can operate in accordance with the present disclosure. The detectors can be located within or on a surface at a top of the elevator car 303 (e.g., a ceiling of the elevator car 303) and point downward or angled toward the elevator car floor. In other embodiments, or in combination therewith, detectors can be located in the upper corners of the elevator car (e.g., on the ceiling, at the top of car walls, etc.) or elsewhere at the top of the elevator car. As will be appreciated by those of skill in the art, the one or more detectors are positioned within the elevator car such that a detection of the occupancy of the elevator car can be made.

The control unit 306 is configured to receive data from the detectors 304 and determine an occupancy level of the elevator car 303. For example, in some embodiments, based on the detection grid 302, the control unit 306 can detect how full the elevator car 303 is. In such an example, if passengers of the elevator car 303 fill a minimum or threshold percentage of the detection grid 302, the control 306 can determine that the elevator car 303 is full and thus send a signal to the elevator controller 315 indicating that the elevator car 303 should not be stopped at any landings where no current passenger has requested to stop.

Such decision can further be carried out with respect to door closing of an elevator car. For example, at any given landing, even with a non-filled elevator car, the elevator car can fill up with passengers or cargo. Accordingly, even during a loading time (e.g., located at a landing with the doors open), the control unit 306 can receive information from the detectors 304 to detect the filling of the elevator car. When the elevator car is detected as full, the control unit 306 can send a signal to the elevator controller 315 (or an elevator car door controller) to close the elevator car doors or prevent the elevator car doors from re-opening if a request is made at an elevator call button once the elevator car is detected to be full.

In some embodiments, a software application can be employed on the control unit 306, such as stored on memory and executed by a processor. The control unit 306 may, in some embodiments, use various detection, counting, or other methods to determine if an elevator car is full. For example, in one non-limiting embodiment, optical cameras (detectors 304) can be used to transmit image data to the control unit 306 and a Viola-Jones object detection framework can be used to count the number of passengers (=object) present in the elevator car. The control unit 306 further can be configured to take into account the number of passengers inside the elevator car and will reopen the elevator car door(s) only if there is free space available inside the elevator car.

In one non-limiting embodiment, a single detector, such as a fish-eye lens camera, can be positioned in the middle of the ceiling surface of an elevator car. In other embodiments, a single camera could be located on or in a side corner of the ceiling of an elevator car. The single camera configurations are selected and oriented such that the camera can capture an image of the whole surface of the elevator car. When the occupancy detection system is first put into service (e.g., just after installation of the elevator car), the occupancy detection system will use the associated detector to take a first image as a "reference image" of an empty elevator car (e.g., occupancy level=0%). Then, the occupancy detection system can operate in normal operation mode, and the detector (e.g., camera) will take an image of the elevator car at some predetermined interval (e.g., every 1 or 2 seconds) in order to determine the available space inside the elevator car by making a comparison with the reference image. When the elevator car is determined to be full, no further landing calls will be accepted by the elevator system until passengers or load (e.g., within a cargo elevator) currently in the elevator car exit the elevator car and reduce the occupancy level.

In some non-limiting embodiments, a threshold or predetermined value of occupancy level can be set such that the occupancy detection system can determine that no further potential passengers should be able to board the elevator car. For example, a minimum threshold could be set at any value. For example, in some embodiments, the minimum threshold can be an occupancy level or percentage that is greater than 50%. Further, in some embodiments, a minimum of 70% occupancy when comparing a currently captured image with the reference image can be set as the threshold value. The minimum threshold occupancy level can be set and based in part in view of observed comfort levels of passengers within an elevator car.

In another example embodiment, or in combination with an optical camera, the detector can include one or more thermal cameras in order to count the number of "heat points" inside an elevator car. In such an embodiment, a reference image may not be required. Further, advantageously, such a configuration may provide improved confidentiality and/or privacy for elevator occupants and passengers.

Further still, in some embodiments, multiple (e.g., three or more) cameras or detectors can be employed to provide multiple different points of view and/or angles. From the multiple different images or data collected from the detectors, a three dimensional model of the occupancy level of the elevator car can be obtained. Such a configuration can operate similar to a 3-D scan as known in the art.

In another embodiment, which can be combined with the above described embodiments, a car load weight device can be used in combination with the occupancy detection systems of the present disclosure. For example, in addition to making an optical detection of the occupancy, a weight consideration may be incorporated into the decision such that an elevator that includes a high weight can be prevented from stopping at floors and taking on additional passengers.

Figure 4:
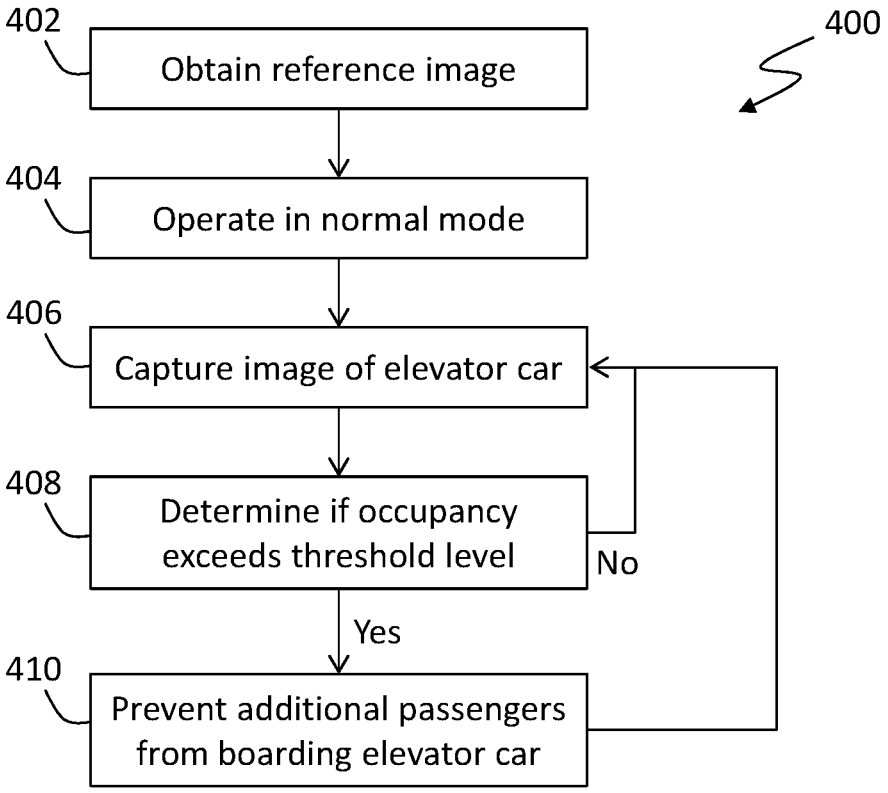
FIG. 4 is a flow process for operating an elevator car in accordance with an embodiment of the present disclosure.

Turning now to FIG. 4, a flow process related to the present disclosure is shown. The flow process 400 can be carried out or executed by a control unit of an occupancy detection system and/or an elevator controller, as described above. The flow process 400, for example, can be carried out by an occupancy detection system that includes one or more detectors configured to detect an occupancy level of an elevator car and a control unit installed within or on an elevator car. In other embodiments, the detectors can be in communication with an elevator controller that is separate or remote from an elevator car. Further still, a various combinations of processing can be employed without departing from the scope of the present disclosure.

At block 402, an optional reference image can be obtained using one or more detectors (e.g., optical cameras). The reference image can be an image of the floor space of an elevator car with no passengers or other items located within the elevator car. That is, the reference image can represent an elevator car with 0% occupancy (i.e., empty).

At block 404, the occupancy detection system can be switched to normal or operational mode. The operational mode can be used whenever the elevator car is in service for normal passenger transportation within and along an elevator shaft. In normal or operational mode, the elevator car can be called to one or more different landings or floors in order to pick up or drop off passengers. Potential passengers can press a hall call button on a hall call panel of the elevator system. The hall call panel will send a request to an elevator controller to stop an elevator car at the indicated landing, when traveling in an appropriate direction within the elevator shaft.

At the same time, or continuously, the occupancy detection system can obtain or capture images of the occupancy of the elevator car, as indicated at block 406. With the captured image, the occupancy detection system can determine if the occupancy of the elevator car exceeds a threshold value or level. For example, in some embodiments, if a reference image is captured at block 402, the occupancy detection system can compare a currently captured image of the elevator car with the reference image. Based on the comparison of the captured image with the reference image, the occupancy detection system can determine an occupancy level of the elevator car.

If it is determined that the elevator car still has room (i.e., "NO"), the flow process 400 returns to block 406 and the process is repeated. That is, when it is determined at block 408 that the threshold occupancy level or value has not been exceeded, the occupancy detection system does not interfere with operation of the elevator car, and additional passengers can be allowed to enter the elevator car. For example, the elevator car can stop at a requesting landing or the elevator car doors can be re-opened when a potential passenger presses the hall call button when the elevator is on the same landing.

However, if it is determined that the elevator car is full at block 408 (e.g., the occupancy threshold level or value is determined to be exceeded), at block 410 the elevator car can be operated to prevent further passengers from attempting to enter the elevator car. For example, in some embodiments, when it is determined "YES" at block 408, the occupancy detection system can send a signal or command to an elevator controller to prevent the elevator car from stopping at any landings where a potential passenger has requested an elevator but no current occupant/passenger has requested to get off the elevator car. That is, the elevator car can be instructed to bypass floors where current passengers will not exit the elevator car. In another example, if the elevator car is at a landing and loading passengers, and the occupancy detection system determines at block 408 that the elevator car is full ("YES"), then the elevator car doors can be commanded to close or, at least, the elevator doors can be prevented from reopening once a door closing operation starts.

Even with operation such that further passengers are prevented from boarding, as described above, the occupancy detection system can continuously perform the flow process 400 (or portions thereof) to ensure the most efficient transportation of passengers within a building. For example, in some instances, passengers may adjust their positions and/or adjust the position of cargo (e.g., boxes, bags, possessions, etc.) such that additional room is made within elevator car. In such situations the occupancy level can decrease even though no passenger entered or exited the elevator car.

Accordingly, occupancy detection system as provided herein can provide improved passenger experience when using an elevator such that minimal time can be wasted. For example, only elevator cars in which a potential passenger can enter will stop at a requested floor, and thus the potential passengers may not need to repeatedly request elevator cars after the elevator doors open and the potential passenger determines that the elevator car is too full to enter. Further, the time of passengers already on an elevator car is not wasted by stopping at floors where no passenger will enter or exit from the elevator car.

Further, advantageously, embodiments provided herein may employ reference images, thermal detection of occupancy, load weight devices, etc. and thus various markings or other detection mechanisms that may be subject to blocking by passengers can be avoided. Moreover, advantageously, embodiments provided herein can enable detection or measuring of cargo (e.g., items, boxes, bags, strollers, etc.) on the floor of an elevator car and not just detection of people. Thus, if an elevator has a single human occupant but is otherwise full of boxes being moved within a building, the occupancy detection system can prevent the elevator car from stopping at floors where no boxes or the person will be exiting.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator control system comprising:

an elevator car;

an elevator controller; and an occupancy detection system configured to detect an occupancy level within the elevator car, the occupancy detection system comprising at least one camera, wherein the at least one camera is configured to generate a detection grid that represents a floor space of the elevator car and the occupancy level is a percentage of the detection grid occupied as compared to an empty elevator car;

wherein the elevator controller and the occupancy detection system control the elevator car to prevent additional passengers from entering the elevator car when the occupancy detection system detects an occupancy level above a predetermined threshold, wherein the predetermined threshold is a threshold percentage of the detection grid that is occupied, and wherein the elevator controller and the occupancy detection system are configured to control the elevator car such that, if a request is made at an elevator call button, the elevator controller will reopen an elevator door of the elevator car only if there is free space available inside the elevator car, wherein the free space available is determined when the occupancy level is below the threshold percentage of the detection grid.

2. The elevator control system of claim 1, wherein the occupancy detection system comprises at least one detector mounted in the elevator car, wherein the at least at least one detector mounted in the elevator car is configured to detect free space available inside the elevator car.

3. The elevator control system of claim 2, wherein the at least one detector comprises a camera.

4. The elevator control system of claim 2, wherein the at least one detector is mounted to at least one of an elevator wall or an elevator ceiling.

5. The elevator control system of claim 1, wherein the predetermined threshold is a value of 50% or greater of occupancy of the elevator car.

6. The elevator control system of claim 1, wherein the occupancy detection system captures a reference image of the elevator car and compares currently captured images with the reference image to determine the occupancy level.

7. The elevator control system of claim 1, wherein preventing additional passengers from entering the elevator car comprises at least one of (i) prevent the elevator car from stopping at any landings where a potential passenger has requested an elevator but no current occupant/passenger has requested to exit, (ii) close the elevator doors of the elevator car, or (iii) prevent reopening of the elevator doors once a door closing operation starts.

8. The elevator control system of claim 1, further comprising a weight sensor configured to provide information to at least one of the elevator controller or the occupancy detection system such that a determination regarding the occupancy level of the elevator car is based in part on the current weight of the elevator car.

9. A method of controlling an elevator comprising:

generating a detection grid that represents a floor space of an elevator car;

detecting an occupancy level within an elevator car with an occupancy detection system, wherein the occupancy level is a percentage of the detection grid occupied as compared to an empty elevator car; and preventing additional passengers from entering the elevator car when the occupancy detection system detects an occupancy level above a predetermined threshold, wherein the predetermined threshold is a threshold percentage of the detection grid that is occupied, wherein, if a request is made at an elevator call button, the method includes reopening an elevator door only if there is free space available inside the elevator car, wherein the free space available is determined when the occupancy level is below the threshold percentage of the detection grid.

10. The method of claim 9, wherein the occupancy detection system comprises at least one detector mounted in a ceiling of the elevator car.

11. The method of claim 10, wherein the at least one detector comprises a camera having a fish-eye lens.

12. The method of claim 9, wherein the predetermined threshold is a value of 50% or greater of occupancy of the elevator car.

13. The method of claim 9, further comprising capturing a reference image of the elevator car and comparing a currently captured image with the reference image to determine the occupancy level.

14. The method of claim 9, wherein preventing additional passengers from entering the elevator car comprises at least one of (i) preventing the elevator car from stopping at any landings where a potential passenger has requested an elevator but no current occupant/passenger has requested to exit, (ii) closing the elevator doors of the elevator car, or (iii) preventing reopening of the elevator doors once a door closing operation starts.

15. The method of claim 9, further comprising detecting a weight of the elevator car, wherein detection of the occupancy of the elevator car includes the detected weight.

* * * * *